US006837790B1

(12) United States Patent
Kaminkow

(10) Patent No.: US 6,837,790 B1
(45) Date of Patent: Jan. 4, 2005

(54) GAMING DEVICE WITH MOVING SCREEN SIMULATION

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 664 days.

(21) Appl. No.: 09/625,884

(22) Filed: Jul. 26, 2000

(51) Int. Cl.[7] ..... A63F 9/24
(52) U.S. Cl. ..... 463/31; 463/20
(58) Field of Search ..... 463/31, 20; 345/473

(56) References Cited

U.S. PATENT DOCUMENTS

| | | | | |
|---|---|---|---|---|
| 4,141,555 A | | 2/1979 | Dean | |
| 4,448,419 A | | 5/1984 | Telnaes | |
| 4,517,558 A | | 5/1985 | Davids | |
| 4,517,654 A | * | 5/1985 | Carmean | 345/636 |
| 4,589,089 A | | 5/1986 | Frederiksen | |
| 4,712,799 A | * | 12/1987 | Fraley | 463/20 |
| 5,375,830 A | | 12/1994 | Takemoto et al. | |
| 5,393,061 A | | 2/1995 | Manship et al. | |
| 5,449,173 A | * | 9/1995 | Thomas et al. | 273/143 R |
| 5,609,524 A | * | 3/1997 | Inoue | 463/20 |
| 5,655,965 A | | 8/1997 | Takemoto et al. | |
| 5,766,074 A | | 6/1998 | Cannon et al. | |
| 5,769,716 A | | 6/1998 | Saffari et al. | |
| 5,833,536 A | | 11/1998 | Davids et al. | |
| 5,836,819 A | * | 11/1998 | Ugawa | 273/121 B |
| 5,876,284 A | * | 3/1999 | Acres et al. | 463/25 |
| 5,951,397 A | | 9/1999 | Dickinson | |
| 5,984,779 A | * | 11/1999 | Bridgeman et al. | 273/138.2 |
| 6,056,642 A | | 5/2000 | Bennett | |
| 6,071,192 A | | 6/2000 | Weiss | |
| 6,086,066 A | * | 7/2000 | Takeuchi et al. | 273/138.2 |
| 6,126,547 A | | 10/2000 | Ishimoto | |
| 6,135,884 A | * | 10/2000 | Hedrick et al. | 273/143 R |
| 6,135,885 A | | 10/2000 | Lermusiaux | |
| 6,210,279 B1 | | 4/2001 | Dickinson | |
| 6,241,609 B1 | * | 6/2001 | Rutgers | 345/419 |
| 6,243,087 B1 | * | 6/2001 | Davis et al. | 345/723 |
| 6,270,411 B1 | * | 8/2001 | Gura et al. | 273/138.2 |
| 6,319,124 B1 | * | 11/2001 | Baerlocher et al. | 273/138.1 |
| 6,375,570 B1 | * | 4/2002 | Poole | 463/20 |

FOREIGN PATENT DOCUMENTS

| | | |
|---|---|---|
| EP | 0688012 A1 | 12/1995 |
| EP | 0908857 A1 | 4/1999 |
| EP | 0984408 A2 | 3/2000 |
| JP | 201 353 255 | 12/2001 |

OTHER PUBLICATIONS

Fey, Marshall, Slot Machines, A Pictorial History of the First Hundred Years, Liberty Belle Books, 1983, p. 79.*

* cited by examiner

*Primary Examiner*—Jessica Harrison
*Assistant Examiner*—Corbett B Coburn
(74) *Attorney, Agent, or Firm*—Bell, Boyd & Lloyd LLC

(57) ABSTRACT

A gaming device which simulates movement of the gaming device screen. The screen displays certain imagery, and after a predetermined event occurs the controller of the gaming device repositions the imagery as a unit, causing the screen to appear to move. This feature, usable in primary and secondary games and in attract and other modes, enhances the enjoyment and entertainment which players experience.

25 Claims, 6 Drawing Sheets

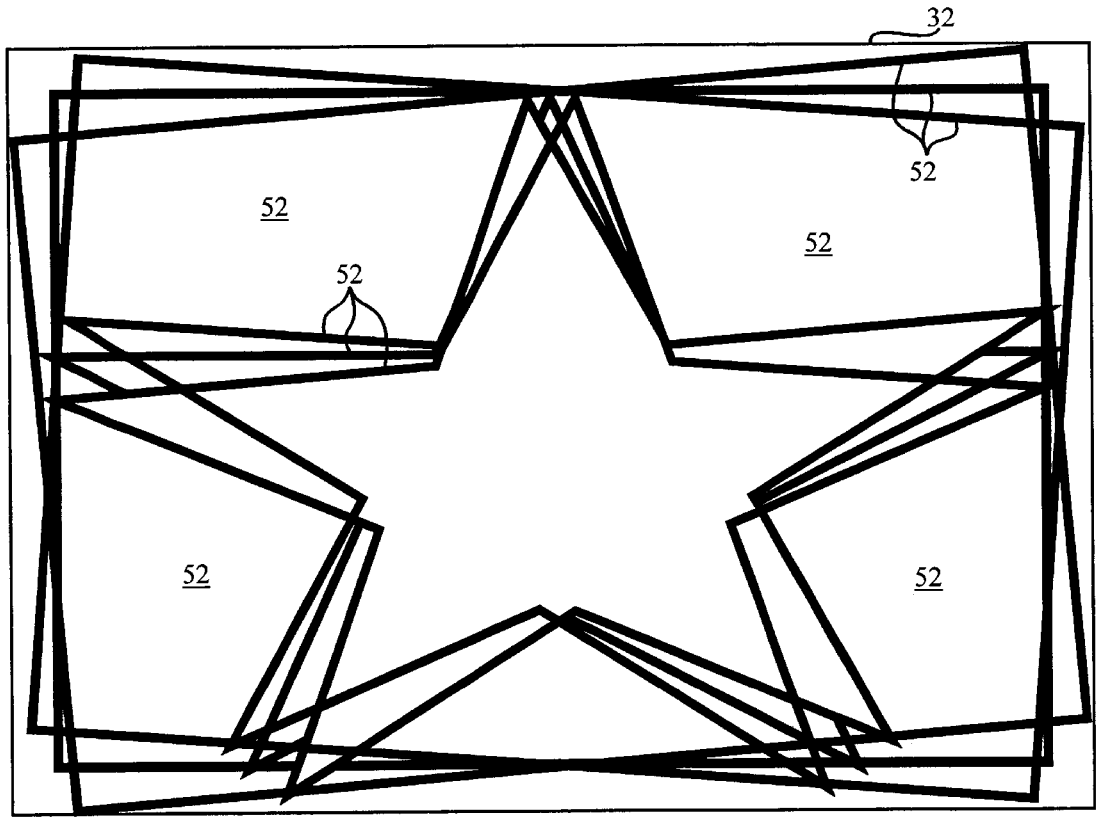
32
52
52
52
52
52
52

GAMING DEVICE WITH MOVING SCREEN SIMULATION

CROSS-REFERENCE TO RELATED APPLICATIONS

This application is related to the following commonly-owned co-pending patent applications: "GAMING DEVICE WITH TRAVELING REEL SYMBOLS," Ser. No. 09/606,928; "GAMING DEVICE WITH BONUS SCHEME HAVING MULTIPLE SYMBOL MOVEMENT AND ASSOCIATED AWARDS," Ser. No. 60/222,159; "GAMING DEVICE WITH BONUS SCHEME PROVIDING AWARDS ASSOCIATED WITH MOVEMENTS ALONG PATH," Ser. No. 09/583,429; "GAMING DEVICE WITH MULTI-PURPOSE REELS," Ser. No. 09/606,733; "GAMING DEVICE HAVING BONUS SCHEME WITH INCREMENTAL VALUE DISCLOSURE," Ser. No. 09/627,198; "GAMING DEVICE WITH SIGNIFIED REEL SYMBOLS," Ser. No. 09/605,344; "GAMING DEVICE HAVING COMPETITION BONUS SCHEME," Ser. No. 09/628,144; "GAMING DEVICE HAVING TOUCH ACTIVATED ALTERNATING OR CHANGING SYMBOL," Ser. No. 09/602,331; "GAMING DEVICE PROVIDING TOUCH ACTIVATED SYMBOL INFORMATION," Ser. No. 09/680,349; "GAMING DEVICE HAVING A REPLICATING DISPLAY THAT PROVIDES WINNING PAYLINE INFORMATION," Ser. No. 09/629,606; "GAMING DEVICE HAVING A CHANGEABLE OBJECT," Ser. No. 09/680,111; "GAMING DEVICE HAVING INTERACTING SYMBOLS," Ser. No. 09/686,308; "GAMING DEVICE HAVING CHANGED OR GENERATED PLAYER STIMULI," Ser. No. 09/686,244; "GAMING DEVICE WITH A BONUS SCHEME INVOLVING MOVEMENT ALONG PATHS WITH PATH CHANGE CONDITIONS," Ser. No. 09/686,538; "GAMING DEVICE WITH TRAVELING REEL SYMBOLS," Ser. No. 09/689,197; "GAMING DEVICE HAVING A SYMBOL COVERING FEATURE," Ser. No. 09/684,275; and "GAMING DEVICE HAVING ANIMATION INCLUDING MULTIPLE SPRITES," Ser. No. 09/689,310.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device which has moving screen simulation.

BACKGROUND OF THE INVENTION

Existing gaming machines, such as traditional slot machines, include a variety of game events. Typical events are the player obtaining certain values or awards, the initiation of a bonus round and the termination of a game. Typically when events such as these occur, the gaming machines have certain features which draw attention to the event and entertain the player. For example, if a player advances to a bonus round, gaming machines often flash lights, make sounds or implement other features. Known gaming machines do not simulate movement of the gaming device screen.

To increase player enjoyment and excitement, it is desirable to provide players with new features for gaming devices, where the new features involve simulated movement of the gaming device screen.

SUMMARY OF THE INVENTION

The present invention overcomes the above shortcomings by providing a gaming device which includes a monitor or screen and imagery displayed on the screen. Preferably, the screen is a video monitor. Imagery is the combination of all images displayed on the screen, including background, color and shading. The gaming device also includes a plurality of events, such as the initiation of a primary game or bonus round, the termination of a primary game or bonus round, a player gaining or losing values or a player gaining or losing opportunities.

When certain events occur (hereafter, "triggering events"), the computer of the gaming device simulates physical movement of the screen by repositioning the imagery on the screen in order to create the illusion that the screen is physically moving. Triggering events can be any occurrences, predetermined or determined by the computer of the gaming device during a primary game or bonus round. For example, imagery which includes trees on a hillside against a sky blue background would fill an entire screen. By repositioning this imagery, the computer can create the illusion that the screen is physically shaking or moving about in some other manner. The computer can reposition the imagery in a variety of manners.

In one embodiment of the present invention, the gaming device includes a plurality of reels, preferably video reels and a plurality of symbols on the reels. Functionally, a plurality of the reels spin, come to a stop and display one or more symbols. One or more reels may not spin and may function solely as a display screen. The term display, as used herein, includes, but is not limited to, showing, performing or otherwise representing a person, place or thing, at rest or in motion, visually and/or audibly.

The symbols which are displayed on each reel in relation to each other form a combination of symbols. When a player reaches a predetermined combination of symbols on the set of reels, a triggering event occurs. The computer then initiates a bonus round and displays an initial bonus round screen which includes imagery including objects against a background such as oil derricks against a solid color background. The computer then performs the moving screen feature on this initial screen by iteratively positioning the imagery at various positions. The effect is to simulate actual vibration or shaking of the screen. Preferably, in the oil derrick embodiment, after the simulation stops, the computer displays oil flowing over the initial bonus round screen. Once the oil display terminates, the computer enables the player to play the bonus round.

The simulated screen movement of the present invention involves the repositioning of imagery which gives the player the illusion that the gaming device screen is moving. The gaming device can perform this feature upon the occurrence of any triggering event and during a primary game or bonus round. The feature of the present invention provides players with additional excitement and entertainment.

It is therefore an object of the present invention to provide a gaming device with moving screen simulation.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 6 is a top plan view of vertically repositioned imagery in one embodiment of the present invention.

DETAILED DESCRIPTION OF THE INVENTION

Gaming Device and Electronics

Figure 1:
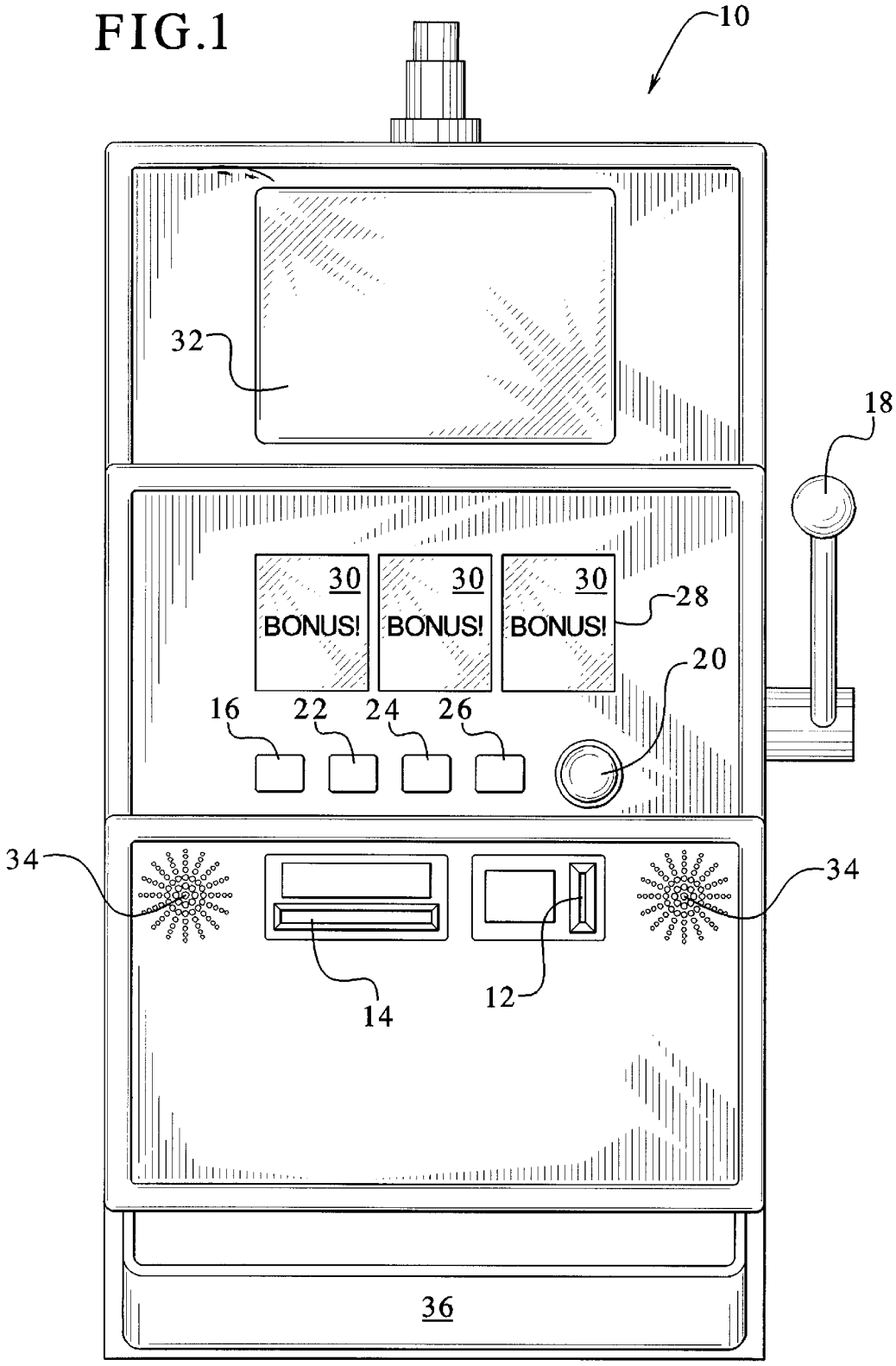
FIG. 1 is a front elevational view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno in addition to any of their bonus triggering events which trigger the bonus scheme of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device 10.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at video monitor or screen 32 instead of at display window 28. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

Figure 2:
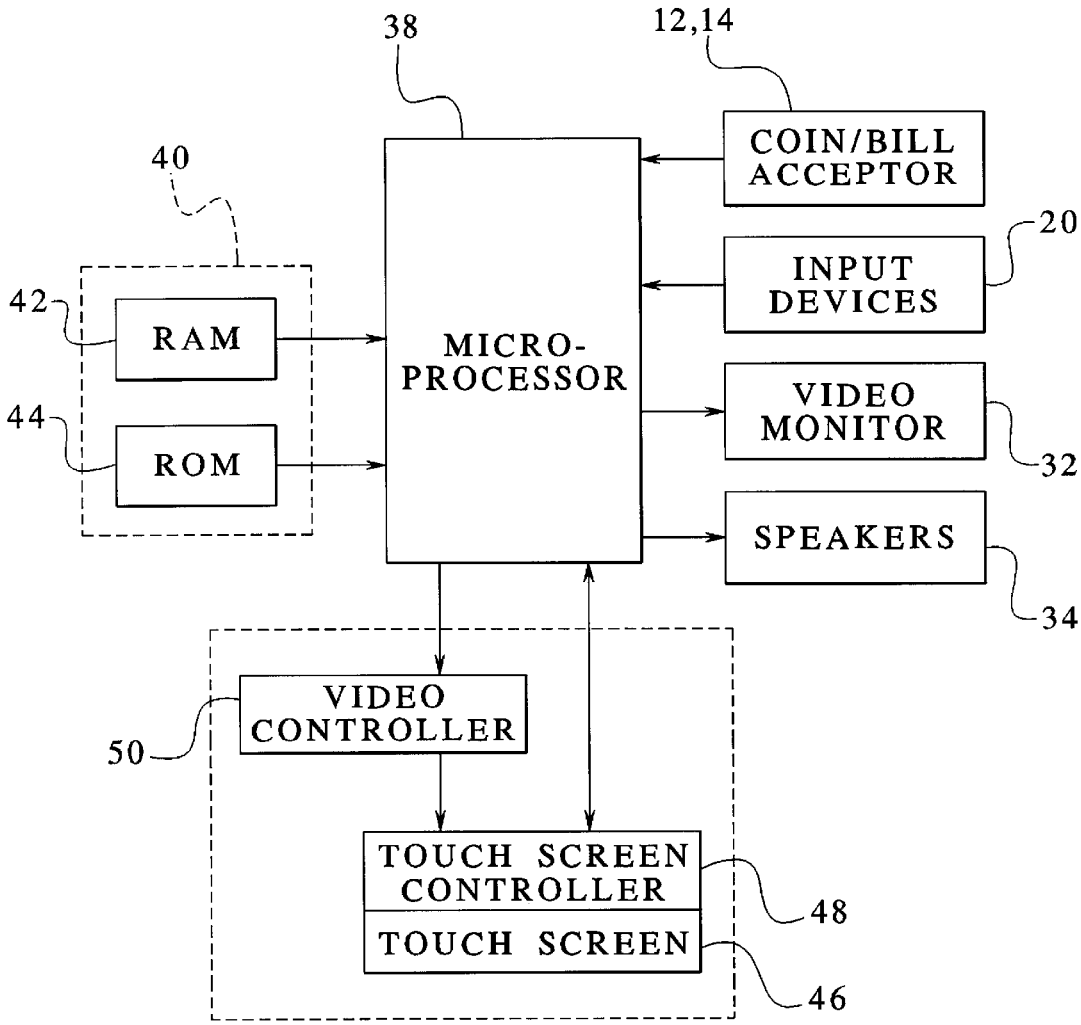
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 38, a memory device 40 for storing program code or other data, a screen 32 and at least one input device such as play buttons 20. The processor 38 is preferably a microprocessor or microcontroller-based platform which is capable of displaying images, symbols and other indicia such as images of people, characters, places, things and faces of cards. Screen 32 is a surface on which images are displayed such as a monitor or other display device (i.e., a liquid crystal display). The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses play buttons 20 to input signals into gaming device 10. Furthermore, it is preferable that touch screen 46 and an associated touch screen controller 48 are used instead of a conventional screen 32. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer."

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also gives players the opportunity to win credits in a bonus round. This type of gaming device 10 will include a program which will automatically begin a bonus round preferably when a predetermined combination of indicia appears on a plurality of reels 30. As illustrated in the three reel slot game shown in FIG. 1, the predetermined combination of indicia could be the text "BONUS!" appearing in the same location on three adjacent reels.

Moving Screen Simulation

Figure 3:
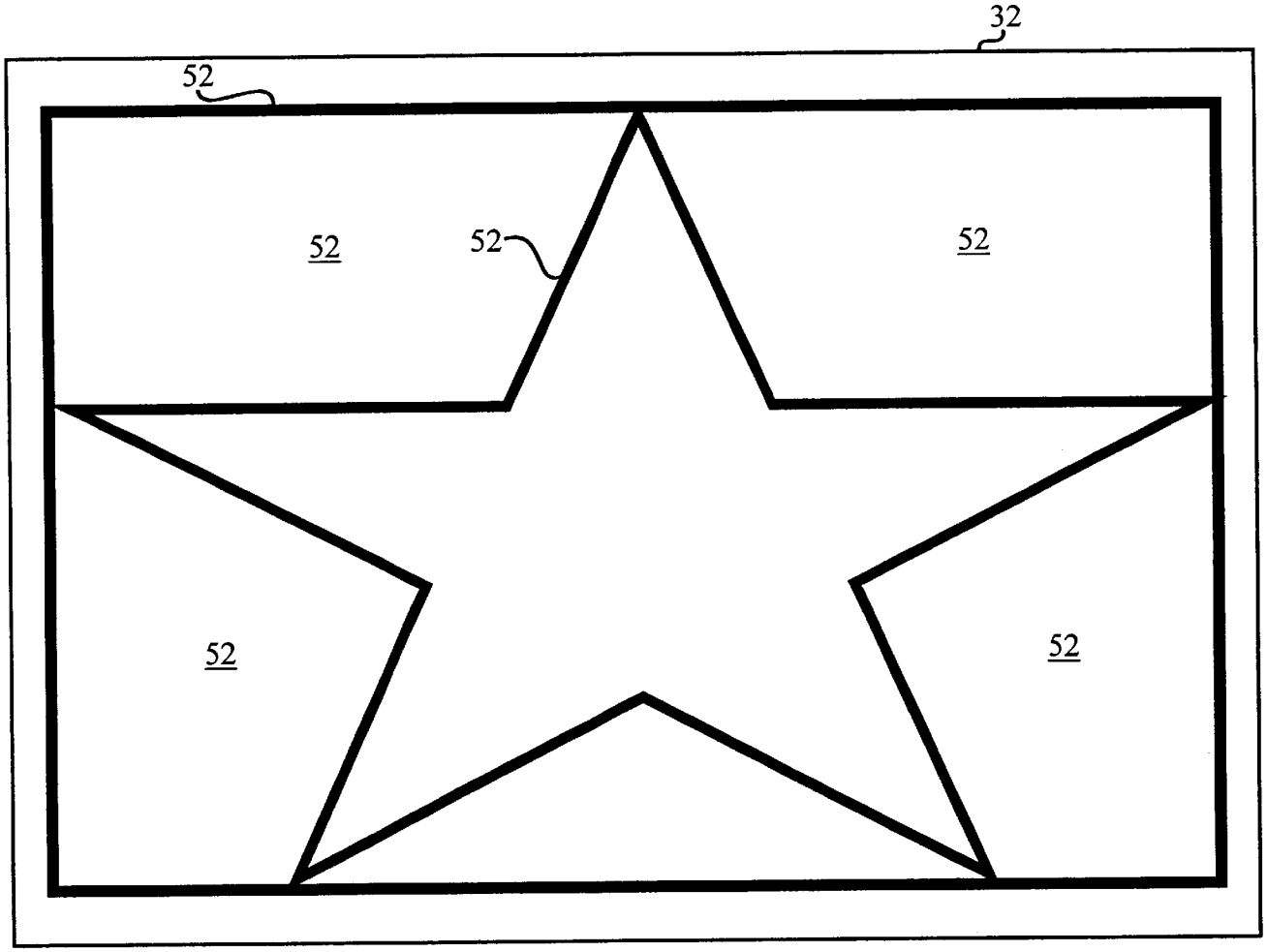
FIG. 3 is a top plan view of the imagery in the gaming device screen in one embodiment of the present invention.

Referring now to FIG. 3, gaming device 10 displays certain imagery 52 on screen 32. For purposes of this application, imagery 52 is illustrated by a star and its rectangular-shaped, white background. During a primary game or during a bonus round, when a triggering event occurs, the gaming device 10 displays this imagery 52. Triggering events are events which occur before, during or after a game or bonus round such as the initiation of a game, the initiation of a bonus round, the player gaining values, the player loosing values, the player gaining opportunities to gain value, the player loosing opportunities to gain value, or the renewal of a game or bonus round. Preferably, when the computer initially displays imagery 52, portions of the imagery 52 are moving. However, it should be appreciated that the present invention can be adapted so that certain portions of imagery 52 do move. For instance, imagery 52 could include the image of a dog on a hillside, where nothing is moving except for the tail of the dog.

In either alternative, the computer displays imagery 52 for a predetermined, relatively short length of time. After this length of time elapses, the computer repositions imagery 52 so as to create the illusion that the physical screen 32 is actually moving. Preferably, the computer accomplishes this simulation by repositioning the entire imagery 52 from position to position in a relatively rapid manner, on screen 32.

Figure 4:
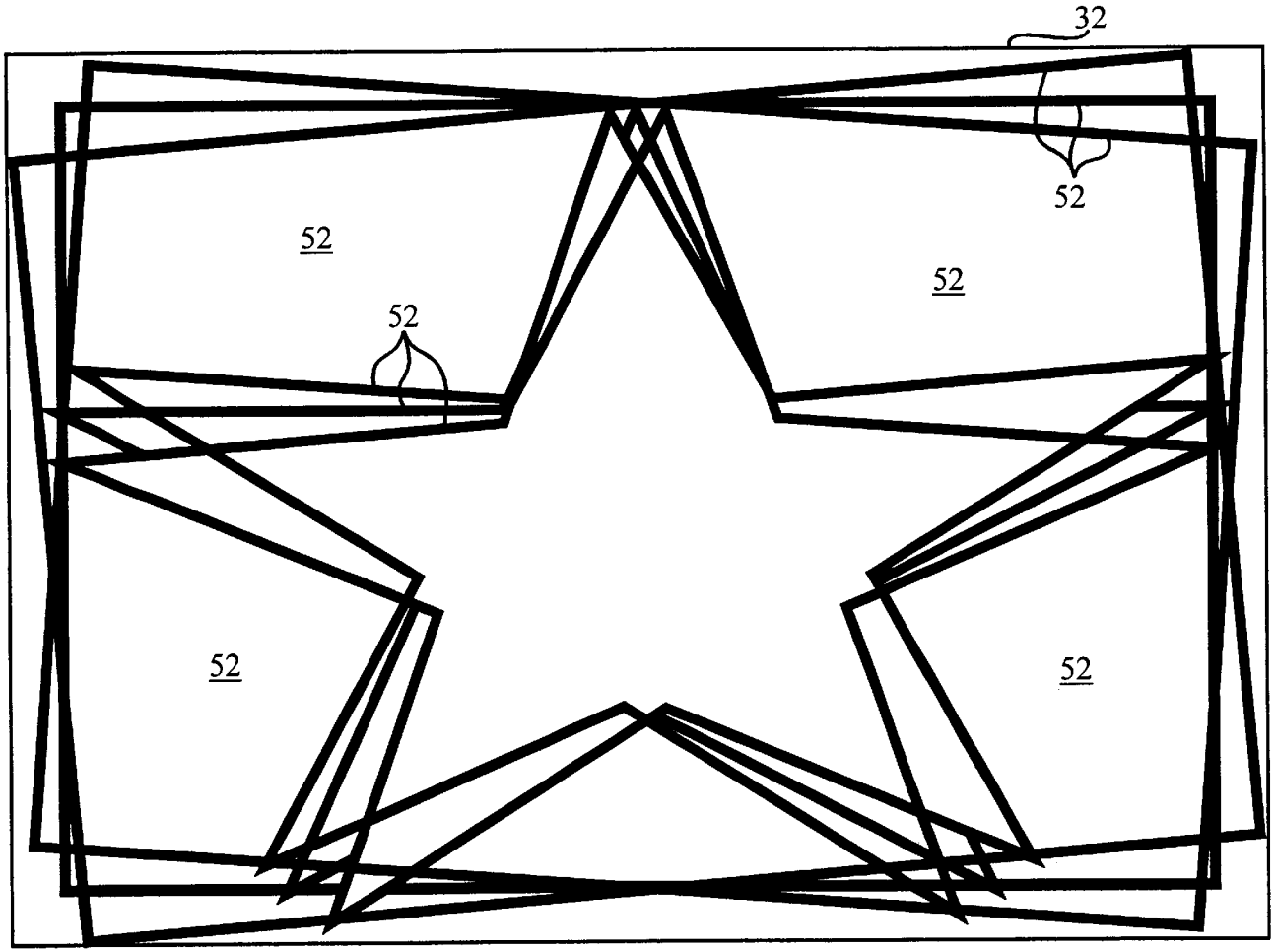
FIG. 4 is a top plan view of angularly repositioned imagery in one embodiment of the present invention.
Figure 5:
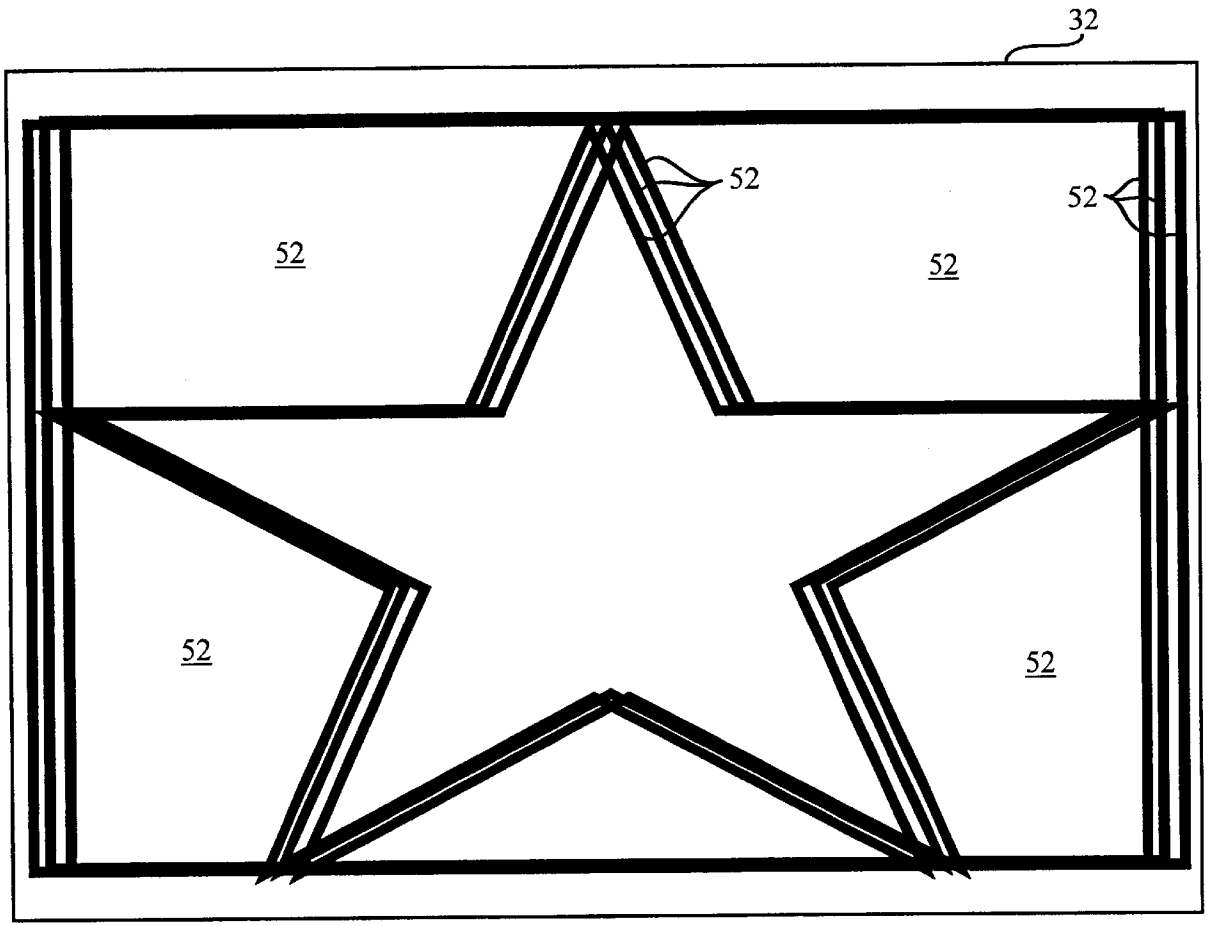
FIG. 5 is a top plan view of horizontally repositioned imagery in one embodiment of the present invention.

Certain reposition techniques are illustrated in FIGS. 4 through 6. In these illustrations, the imagery is repositioned from its original position to two new positions. However, the imagery can be repositioned to any number of positions. In FIG. 4, the new positions have angular alignments which are different from each other and different from the original position. In FIG. 5, the new positions are horizontally displaced to the left and right of the imagery's original location, and in FIG. 6, the new positions are vertically displaced above and below the imagery's original location. The computer displays the imagery 52 iteratively at these different locations, thereby creating the illusion that screen 32 is physically vibrating or shaking.

It should be appreciated that the computer can reposition or otherwise manipulate the imagery 52 in a variety of manners so as to create various screen simulations. For instance, the computer can rotate imagery 52, shift imagery 52 upwards or downwards or from side to side or combine any of these manipulations. Furthermore, the computer can reposition the imagery 52 to any number of new locations.

Eventually the computer stops repositioning the imagery 52, and the simulation is complete. Following the simulation, the primary game or bonus round may continue, terminate or other events may occur depending upon the particular program of the game or bonus round.

In one preferred embodiment of the present invention, the primary game involves a plurality of reels 30, preferably video reels. The reels 30 display a plurality of symbols. By pushing play button 20, the player causes the reels 30 to spin. When the reels 30 stop spinning, if a predetermined combination of symbols is displayed, a triggering event occurs and the computer initiates a bonus round. In this preferred embodiment, after the player reaches this triggering event, the computer displays an initial bonus screen-shot. This bonus screen-shot displays certain imagery 52 which is a plurality of oil derricks against a solid color background.

Initially, the oil derricks and the background are stationary for a predetermined amount of time. After this time elapses, the computer repositions the oil derricks and background (as a whole) from one position to another on the screen 32 for a predetermined length of time. This process of repositioning creates the illusion that the physical screen 32 is vibrating or shaking. After this simulation is complete, the oil derricks and background become stationary.

It is preferable that next, the computer displays liquid oil spilling or flowing onto screen 32. The computer carries out this visual oil spillage for a predetermined length of time and then replaces this imagery with a third bonus round screen-shot where the computer enables the player to play the bonus round. The player then plays the bonus round until it terminates. Preferably, the imagery and symbols in this embodiment are related to the theme of oil business in the State of Texas of the United States.

The simulated screen movement feature of the present invention involves certain imagery which the computer repositions from position to position on a gaming device screen. The rapid repositioning of the imagery creates the illusion that the screen is actually moving (i.e., vibrating, shaking, floating, drifting or rocking). In this manner, the computer simulates physical movement of the screen. This simulation can be included in primary games or bonus rounds of gaming devices. Furthermore, this feature can be used to accompany any event during a primary game or bonus round. The use of this feature adds excitement, entertainment and enjoyment to primary games and bonus rounds of gaming devices.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

What is claimed is:

1. A gaming device comprising:

a video screen having a plurality of images and a plurality of positions for the plurality of images;

at least one triggering event; and means for repeatedly repositioning the plurality of images as a unit in a coordinated manner to at least two of the positions to simulate movement of the entire video screen upon the occurrence of a triggering event.

2. The gaming device of claim 1, wherein at least two of the positions have different angular alignments.

3. The gaming device of claim 1, wherein at least two of the positions are horizontally displaced from each other.

4. The gaming device of claim 1, wherein at least two of the positions are vertically displaced from each other.

5. The gaming device of claim 1, wherein at least one portion of at least one of the positions overlaps with at least one portion of another position.

6. A gaming device comprising:

a video screen having a plurality of imagery positions;

imagery including a plurality of images located at one of the imagery positions; and means for iteratively repositioning the imagery including said plurality of images as a coordinated unit between at least two of said imagery positions upon the occurrence of a triggering event such that when the imagery is iteratively repositioned, the entire video screen appears to move.

7. The gaming device of claim 6, wherein at least two of the imagery positions have different angular alignments.

8. The gaming device of claim 6, wherein at least two of the imagery positions are horizontally displaced from each other.

9. The gaming device of claim 6, wherein at least two of the imagery positions are vertically displaced from each other.

10. An improved gaming device including a video screen having a plurality of imagery positions, said video screen adapted to display imagery including a plurality of images at any of the imagery positions, wherein the improvement comprises means for repeatedly repositioning the imagery, including the plurality of images as a coordinated unit, to at least two imagery positions to simulate movement of the entire video screen.

11. The improved gaming device of claim 10, wherein the means for repeatedly repositioning the imagery repositions the imagery to more than two positions.

12. A method for operating a gaming device, said method comprising the steps of:

(a) providing a plurality of image positions on a video screen;

(b) displaying a plurality of images as a coordinated unit at one of said image positions on said video screen; and (c) repeatedly repositioning the plurality of images as a coordinated unit to at least two of the image positions for a predetermined length of time to simulate movement of the entire video screen.

13. The method of claim 12, which includes the step of repositioning the plurality of images as a coordinated unit to at least two image positions which have different angular alignments.

14. The method of claim 12, which includes the step of repositioning the plurality of images as a coordinated unit to at least two image positions which are horizontally displaced from one another.

15. The method of claim 12, which includes the step of repositioning the plurality of images as a coordinated unit to at least two image positions which are vertically displaced from one another.

16. The method of claim 12, wherein the gaming device is operated through a data network.

17. The method of claim 16, wherein the data network is an internet.

18. A method for operating a gaming device, said method comprising the steps of:

(a) providing a plurality of positions on a video screen;

(b) displaying imagery including a plurality of images at one of the positions on the video screen;

(c) causing a triggering event to occur; and (d) iteratively repositioning the imagery, including the plurality of images as a coordinated unit, from one position to a different position for a predetermined length of time to simulate movement of the entire video screen.

19. The method of claim 18, which includes the step of repositioning the imagery to at least two positions which have different angular alignments.

20. The method of claim 18, which includes the step of repositioning the imagery to at least two positions which are horizontally displaced from one another.

21. The method of claim 18, which includes the step of repositioning the imagery to at least two positions which are vertically displaced from one another.

22. The method of claim 18, wherein the gaming device is operated through a data network.

23. The method of claim 22, where the data network is an internet.

24. In a method for operating a gaming device of the type which provides a video screen which includes a plurality of positions and displays imagery including a plurality of images at one of the positions, the improvement comprising: repositioning the imagery including the plurality of images as a coordinated unit so as to create an illusion that the entire video screen is moving.

25. The method of claim 24, which includes the step of iteratively repositioning the imagery to a plurality of the positions.

* * * * *